US006676535B2

(12) United States Patent
Sheets et al.

(10) Patent No.: US 6,676,535 B2
(45) Date of Patent: Jan. 13, 2004

(54) GOLF CLUB HEAD HAVING A LOW AND DEEP WEIGHT DISTRIBUTION

(75) Inventors: Jeffrey D. Sheets, Aurora, IL (US); Carl E. Scheie, Gold Canyon, AZ (US); Douglas J. Thiel, Streamwood, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 96 days.

(21) Appl. No.: 09/993,222

(22) Filed: Nov. 6, 2001

(65) Prior Publication Data

US 2003/0087710 A1 May 8, 2003

(51) Int. Cl.[7] ..... A63B 53/04
(52) U.S. Cl. ..... 473/328; 473/345; 473/349
(58) Field of Search ..... 473/324, 345, 473/346, 349, 290, 291, 292, 338, 327, 328; D21/752

(56) References Cited

U.S. PATENT DOCUMENTS 4,214,754 A * 7/1980 Zebelean
4,432,549 A * 2/1984 Zebelean
4,438,931 A * 3/1984 Motomiya
4,840,380 A * 6/1989 Kajita
D307,783 S * 5/1990 Iinuma
5,013,041 A * 5/1991 Sun
5,050,879 A * 9/1991 Sun
5,271,620 A * 12/1993 Moriguchi
5,306,450 A * 4/1994 Okumoto
5,398,935 A * 3/1995 Katayama
D358,438 S * 5/1995 Moore
5,421,577 A * 6/1995 Kobayashi
5,465,970 A * 11/1995 Adams
5,467,988 A * 11/1995 Henwood
D369,392 S * 4/1996 Adams et al. ..... D21/733
5,516,107 A * 5/1996 Okumoto
5,518,243 A * 5/1996 Redman
D379,391 S * 5/1997 Moore
5,669,827 A * 9/1997 Nagamoto
5,709,617 A * 1/1998 Nishimura
5,720,674 A * 2/1998 Galy
5,746,666 A * 5/1998 Lovett
5,755,624 A * 5/1998 Helmstetter
5,779,565 A * 7/1998 Adams
5,785,609 A * 7/1998 Sheets
5,788,584 A * 8/1998 Parente
5,797,807 A * 8/1998 Moore
D397,748 S * 9/1998 Moore
D398,682 S * 9/1998 Moore
5,807,188 A * 9/1998 Serrano
D402,339 S * 12/1998 Sheets et al. ..... D21/733
D402,340 S * 12/1998 Sheets
5,851,160 A * 12/1998 Rugge
6,048,278 A * 4/2000 Meyer
D425,953 S * 5/2000 Glod
6,074,310 A * 6/2000 Ota
6,231,455 B1 * 5/2001 Chang
6,238,300 B1 * 5/2001 Igarashi
6,494,790 B1 * 12/2002 Toyota
D469,836 S * 2/2003 Mendralla et al. ..... D21/759

* cited by examiner

*Primary Examiner*—Sebastiano Passaniti
(74) *Attorney, Agent, or Firm*—Terence P. O'Brien

(57) ABSTRACT

An integral, hollow metal golf club head including a sole plate, a crown, a face, first and second side walls and a rear wall. The club head includes The sole plate has a rear sole portion. The crown has a rear crown portion. The upwardly and substantially vertically extends from the rear sole portion to the rear crown portion. The rear wall and the face connect the sole plate to the crown. The sole plate has a substantially planar central portion positioned between first and second outwardly and upwardly curved side portions. The central portion rearwardly extends from the face to the rear wall. The sole plate has first and second shoulders formed by the rearward extension of the central portion beyond the first and second rearmost points of the first and second side portions, respectively.

22 Claims, 6 Drawing Sheets

GOLF CLUB HEAD HAVING A LOW AND DEEP WEIGHT DISTRIBUTION

FIELD OF THE INVENTION

The present invention relates generally to a golf club head. In particular, the present invention relates to a golf club head having a weight distribution, and a trailing edge, that is low and deep.

BACKGROUND OF THE INVENTION

Wood-type and metal wood-type golf clubs, including drivers, are well known and are primarily designed to achieve maximum distance upon impact with a golf ball. Those skilled in the art understand that the most effective way to produce maximum distance when impacting a ball with a golf club head is to combine a high launch angle with a low amount of back spin. A high launch angle is desirable because it dynamically lofts the ball up into the air for a longer duration than lower launch angles. The higher launch angle generally enables the ball to carry or travel further than balls launched at lower launch angles. Low backspin is desirable because it reduces the lift produced by backspin. Backspin can cause a golf ball to excessively rise or balloon upward, which accelerates the ball's energy consumption, thereby negatively effecting the distance traveled by the ball. In addition, lower spin reduces the side spin effect, thereby reducing slicing and hooking action of the golf ball. Also, lower back spin permits the ball to roll more freely upon landing on the fairway for increased distance.

Wood-type golf clubs, including drivers, typically include a ball striking face, a crown, a sole plate and a side wall. The crown defines the upper surface of the club head and the sole plate defines the lower surface of the club head. The crown typically has a larger surface area than that of the sole plate. Also, when viewing a typical wood-type golf club head from the side at an angle substantially perpendicular to the face of the club head, a rear portion of the side wall typically extends upwardly and rearwardly from the rear end of the sole plate.

Wood-type club heads of this type have a number of drawbacks. First, the larger crown and the upwardly and rearwardly curved rear portion of the club head generally makes the club head top heavy having a high center of gravity. A club head with a high center of gravity requires a greater loft angle in order to achieve a proper launch angle. Further, it is generally more difficult to get a club head having a high center of gravity under the ball during play. Moreover, a higher center of gravity increases the vertical gear effect of the club head. Vertical gear effect describes the condition wherein the face of the club head, when impacting the ball, imparts a back spin onto a ball. The backspin is a byproduct of the pendular path of the club head through the ball during a swing. A club head with a higher center of gravity will impart more back spin onto the ball during impact than a club head with a low center of gravity.

Secondly, metal wood-type golf club heads typically have a center of gravity located near the face of the club head. Such forward positioning of the center of gravity reduces the launch angle of the club head and the ability of the club head to dynamically loft the ball. As a result, greater loft angles are required on the face of the club head to achieve the desired launch angle.

Others have produced metal wood-type golf club heads having a relatively low center of gravity primarily by: increasing the overall size of the sole plate with respect to the crown; adding additional layers of material or otherwise weighting the sole plate. Although such designs can achieve a lower club head center of gravity, they typically do not effect the position of the center of gravity along a horizontal plane. As such, these clubs typically do not optimize the launch angle of the club head.

Club heads have also been produced that have a center of gravity rearwardly positioned away from the face of the club head. These existing club heads typically include the addition of one or more weight members to the club head or additional separate layers of material that can make the club head more difficult to produce reliably and cost effectively.

Thus, there is a continuing need for a golf club head that enables a user to launch a golf ball at an optimum loft angle and with optimum backspin. There is also a continuing need for a metal wood-type club head, including a driver, which optimizes the location of the club head's center of gravity. It would be advantageous to provide a golf club head that increases the carry and roll of a golf ball. What is needed is a golf club head having a center of gravity that is low and positioned rearward of the face of club head without relying on the addition of extra weight members or extra layers of material.

SUMMARY OF THE INVENTION

The present invention provides an integral, hollow metal golf club head. The club head includes a sole plate, a crown, a face, first and second side walls and a rear wall. The sole plate has a rear sole portion. The crown has a rear crown portion. The upwardly and substantially vertically extends from the rear sole position to the rear crown portion. The rear wall and the face connect the sole plate to the crown.

According to a principal aspect of a preferred form of the invention, a single walled, hollow metal golf club head having a geometric center and a center of gravity. The club head includes a crown, a sole plate, a toe portion, a heel portion, a face, a hosel and a side wall. The crown has a rearwardly extending rear crown portion. The crown has a first thickness. The sole plate has a rearwardly extending and substantially planar rear sole portion. The sole plate has a second thickness that is greater than the first thickness. The face extends between the toe portion and heel portion. The face has an upper edge. The hosel upwardly extends from the crown and is disposed at the toe portion adjacent to the face. The side wall upwardly extends from the sole plate to the crown. The center of gravity of the club head is lower than the geometric center of the club head, and is rearward of a vertical plane that extends through a centerline of the hosel and is substantially parallel to the upper edge of the face.

According to another preferred aspect of the invention is provided. An integral, hollow metal golf club head includes a face, a rear wall and a sole plate. The sole plate has a substantially planar central portion positioned between first and second outwardly and upwardly curved side portions. The central portion rearwardly extends from the face to the rear wall. The first and second side portions rearwardly extend to first and second rearmost points on the sole plate, respectively. The sole plate has first and second shoulders formed by the rearward extension of the central portion beyond the first and second rearmost points of the first and second side portions, respectively.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
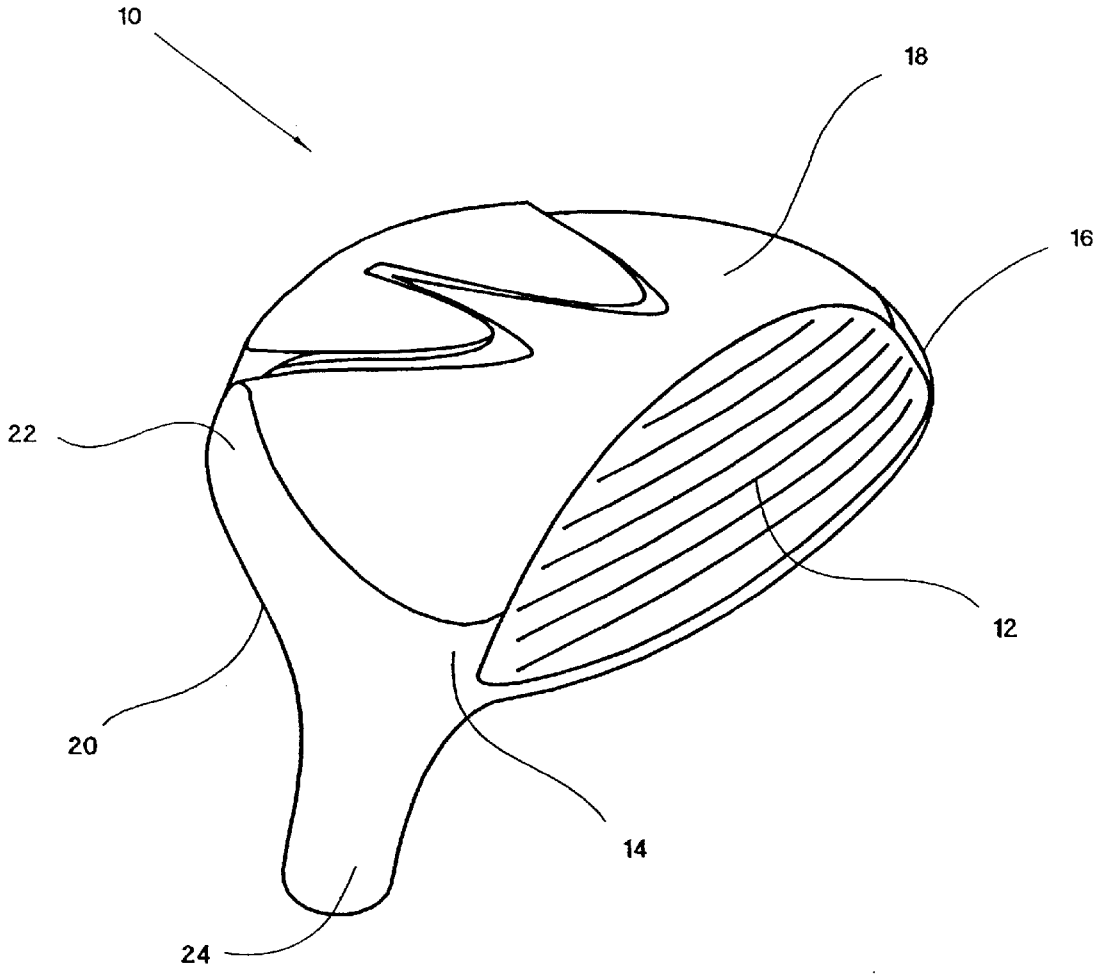
FIG. 1 is a bottom front perspective view of a golf club head in accordance with a preferred embodiment of the present invention.

Referring to FIG. 1, a metal, wood-type golf club head is indicated generally at 10. The club head 10 of FIG. 1 is configured as a #1 driver club head having a 10.5 degree loft. The present invention can also be formed as, and is directly applicable to, #1 drivers having different degrees of loft, and to #2 through #9 metal, wood-type club heads. The club head 10 is a rounded preferably hollow body. The club head 10 is coupled to a golf club shaft (not shown). The club head 10 is made of a high tensile strength, durable material, preferably a stainless steel or titanium alloy. Alternatively, the club head 10 can be made of other materials, such as, for example, aluminum, other steels, metals, alloys, or ceramics.

The club head 10 includes a generally vertical front strike face 12 extending from a heel portion 14 of the club head 10 to a toe portion 16 of the club head 10. The club head 10 also includes a sole plate 18 and a crown 20 rearwardly extending from lower and upper portions of the front strike face 12, respectively. A side wall 22 connects the sole portion 18 to the crown 20 at perimeter locations other than at the front strike face 12. The club head 10 further includes a hosel 24 upwardly extending from the crown 20 adjacent to the front strike face 12 at the heel portion 14. The hosel 24 is configured to connect to the golf club shaft. The club head 10 is preferably formed as a single unitary, integral body through a combination of casting and welding. In an alternative preferred embodiment, the club head 10 is formed through a combination of forging and welding. In other alternative embodiments, the components of the club head can be formed through casting, forging, welding, or a combination thereof. The single walled, unitary configuration of the club head 10 can be produced reliably and often more efficiently than more complex configurations, such as, double walled heads, or heads having weight ports.

Figure 2:
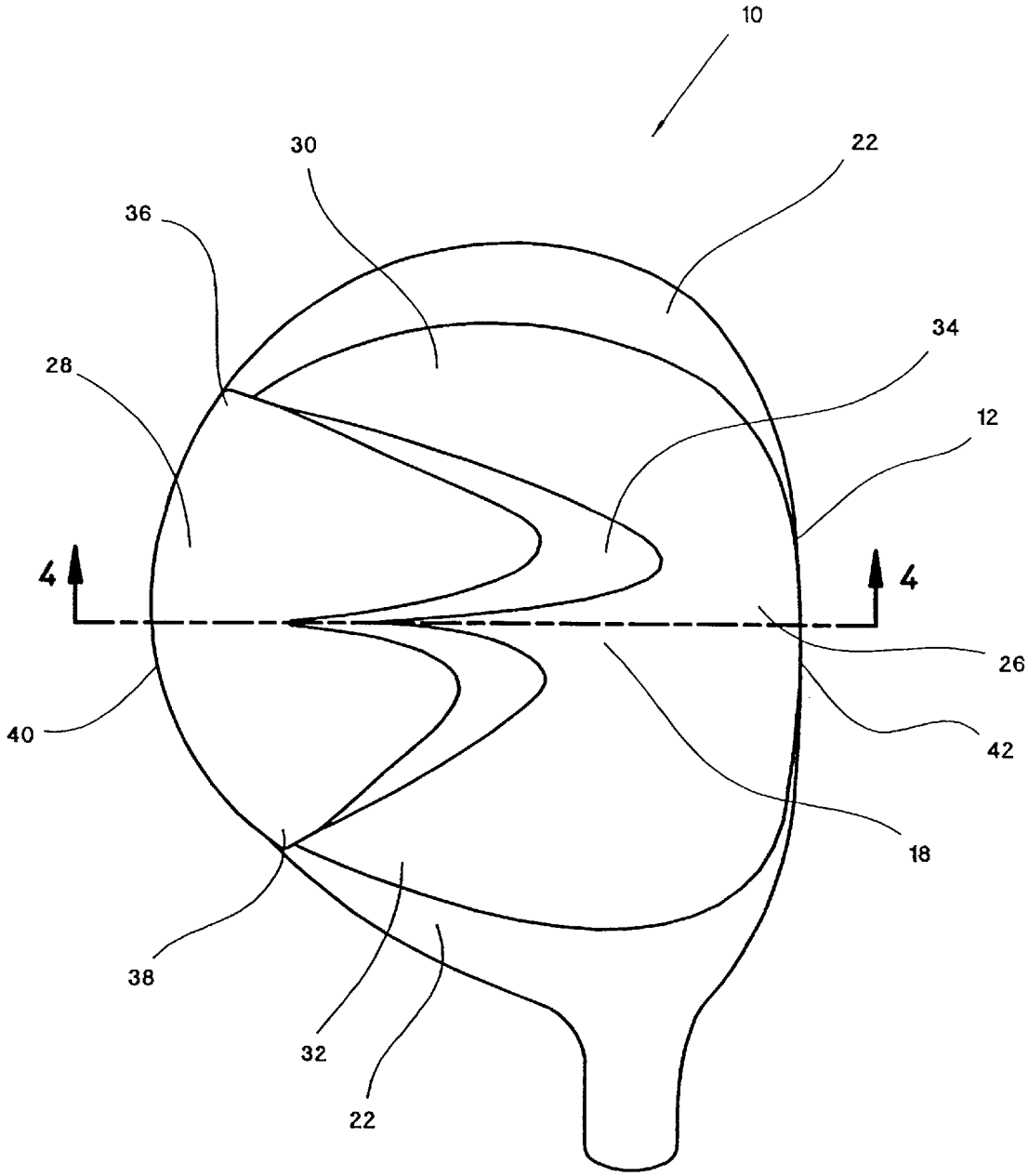
FIG. 2 is a bottom view of the golf club head of FIG. 1.

Referring to FIG. 2, the sole plate 18 of the club head 10 is shown in greater detail. The sole plate 18 is a sheet of material having front and rear central portions 26 and 28, and first and second side portions 30 and 32. The front and rear central portions 26 and 28 are generally planar and are separated by a curved groove 34 defined into the sole plate 18. The front and rear central portions 26 and 28 space apart the first and second side portions 30 and 32. The first and second side portions 30 and 32 are curved members that outwardly and upwardly extend from the front and rear central portions 26 and 28 to the side wall 22. The rear central portion 28 of the sole plate 18 preferably rearwardly extends beyond the first and second side portions 30 and 32 to form first and second shoulders 36 and 38 at the rear most points of the first and second side portions 30 and 32. The groove 34 spaces apart the front and rear central portions 26 and 28, and improves the aesthetics of the sole plate 18. The configuration of the sole plate 18, including the rearwardly projecting rear central portion 28, shifts the sole plate's weight more rearward than conventional sole plate configurations.

A trailing edge 40 is formed at the connection of the rear central portion 28 of the sole plate 18 and a rear portion of the side wall 22, and a leading edge 42 is formed at the connection of the front central portion 26 of the sole plate 18 and the strike face 12. When the club head 10 is positioned in a neutral play position with the front and rear central portions 26 and 28 extending across a generally horizontal surface, the vertical position or height of the leading and trailing edges 42 and 40 is preferably generally equal. Thus, the club head 10 maintains the trailing edge 40 at a low and deep position that accentuates the low and deep weighting of the club head 10.

Figure 3:
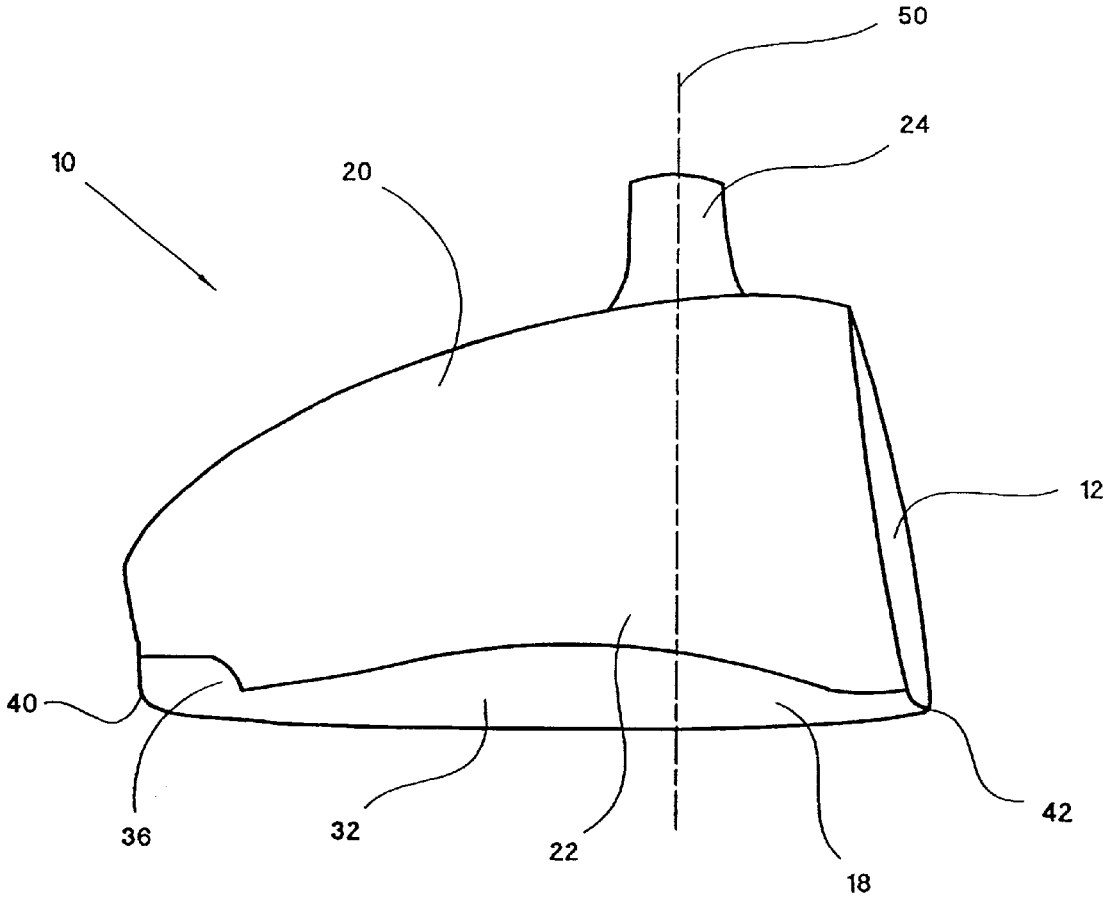
FIG. 3 is a side view of the golf club head of FIG. 1.
Figure 4:
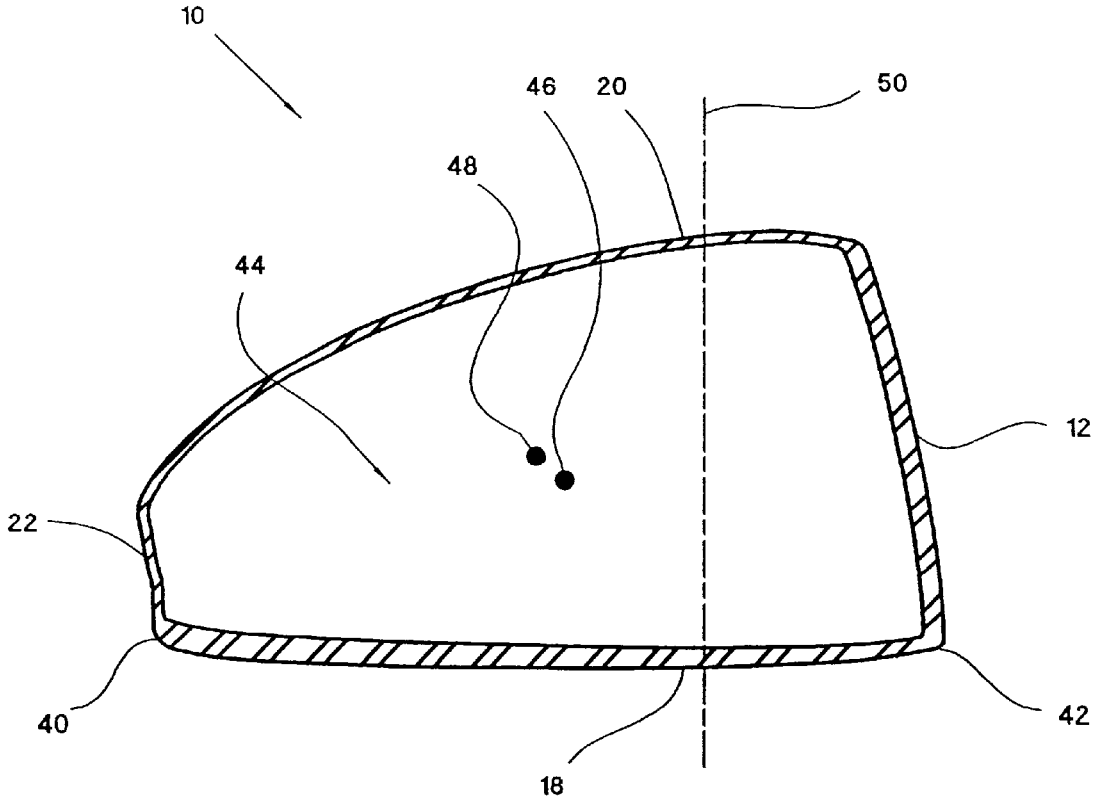
FIG. 4 is a vertical cross-sectional view of the golf club head taken along line 4—4 of FIG. 2.

FIGS. 3 and 4 illustrate the club head 10 in greater detail. Referring to FIG. 3, the crown 20 is a curved sheet extending over the upper surface of the club head 10. The hosel 24 upwardly extends from the crown 20. A vertical plane 50 extends through the center of the hosel 24 substantially parallel with the leading edge 42 of the club head 10. The plane 50 also generally corresponds to the centerline of the shaft. The side wall 22 rearwardly extends from the strike face 12 at the toe and heel portions 14 and 16 (see FIG. 1) toward the rear end of the club head 10. The crown 20 and the side wall 22 can be painted or otherwise formed in one or more colors that are different than that of the strike face 12 and/or the sole plate 18. For example, the crown 20 and the side wall 22 can be formed in a deep red color and the strike face 12 and sole plate 18 can be formed with a metallic silver color. The rear end of the side wall 22 upwardly extends from the rear central portion 28 of the sole plate 18 at the trailing edge 40. Preferably, the rear end of the side wall 22 substantially vertically extends from the rear central portion 28 at the trailing edge 40 and connects to the crown 20 providing the rear end of the club head 10 with a low, deep generally squared off shape. The low, deep, squared-off shape shifts more of the club head's weight low and deep and drives the center of gravity of the club head 10 lower and deeper. The lower center of gravity 48 results in less back spin being imparted to a ball during impact with the club head 10. Further, the deep or rearward position of the center of gravity further increases the dynamic loft of the club head 10.

Referring to FIG. 4, the strike face 12, the sole plate 18, the crown 20 and the side wall 22 form an internal cavity 44 within the club head 10. The cavity 44 is preferably empty. In alternative preferred embodiments, the cavity 44 can be at least partially filled with a fill material, such as, for example, a foam, or an elastomer. The club head 10 and the cavity 44 can be formed in a variety of different sizes. In particularly preferred embodiments, the club head 10 can be formed with a volume of 305, 365 or 425 cubic centimeters. The crown 20 of the club head 10 is formed having a first thickness and the sole plate 18 is formed having a second thickness. In a preferred embodiment, the second thickness is greater than the first thickness increasing the thickness of the sole plate 18 with respect to the crown 20 and thereby further drawing the weight and the center of gravity of the club head 10 lower.

Figure 5:
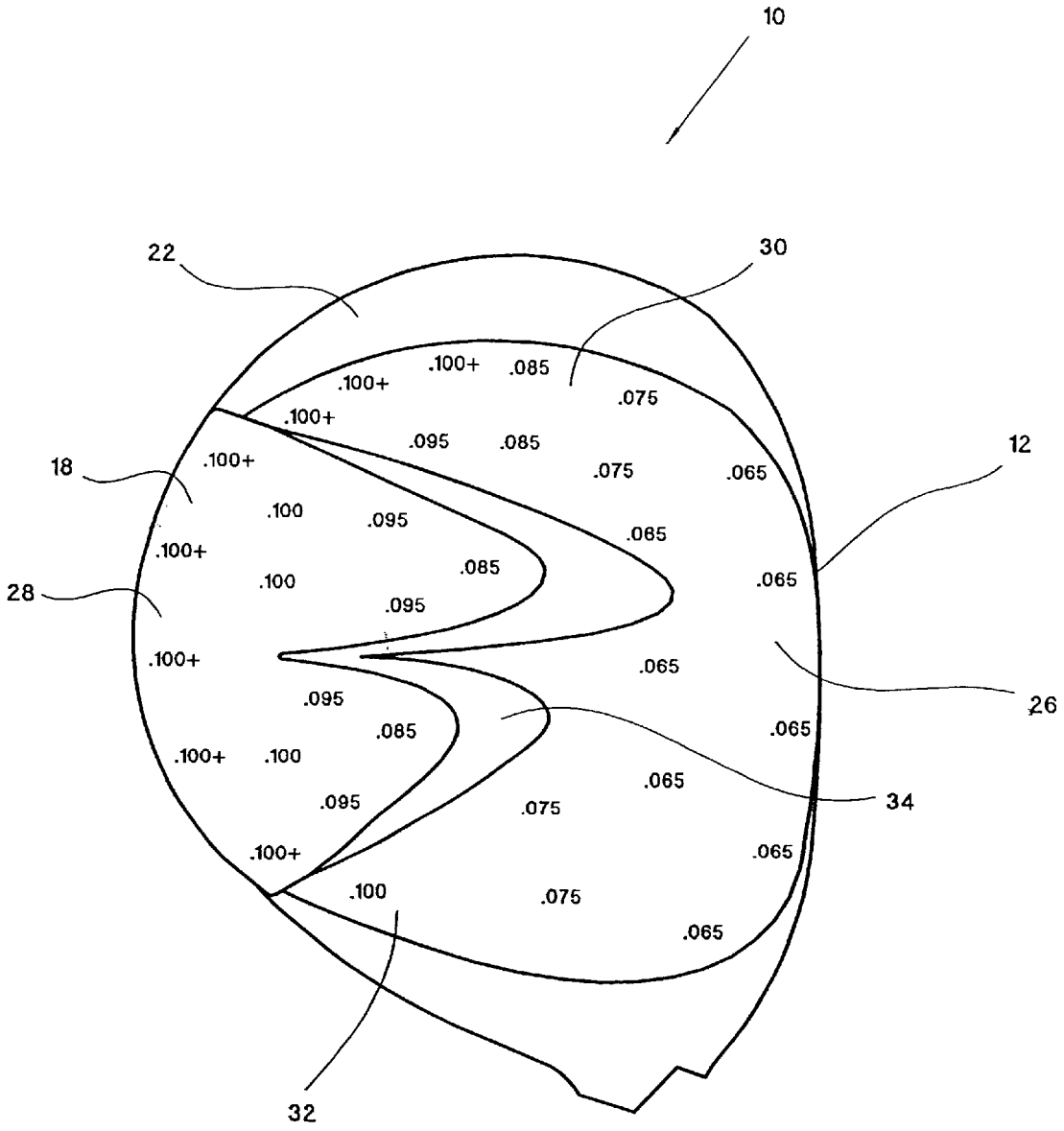
FIG. 5 is a bottom view of the golf club head of FIG. 1 illustrating one particularly preferred embodiment of the present invention.

Referring to FIG. 5, in a particularly, preferred embodiment, the sole plate 18 can be formed with a variable tapered thickness that increases away from the strike face 12. One particularly preferred embodiment of the variable thickness of the sole plate 18 is shown in FIG. 5. FIG. 5 illustrates the approximate thickness of the sole plate 18 of the club head 10 at various locations about the sole plate 18. In one particularly preferred embodiment, the sole plate 18 thickness is: approximately 0.065 inch at a location adjacent to the strike face 12; approximately 0.085 inch at the center of the sole plate 18; and approximately 0.100 inch at the rear portion of the sole plate 18. The maximum thickness of the sole plate 18 extends across the rear region of the rear central portion 28 and the rear most locations of the first and second side portions 30 and 32 of the sole plate 18 to form a band of maximum thickness that resembles a horseshoe. The thicker tapered sole plate 18 further enables the center of gravity of the club head to be drawn lower and deeper on the club head 10. In alternative preferred embodiments, the sole plate 18 can be formed with a uniform thickness or with a rearward taper having a different or non-uniform slope.

Referring to FIG. 4, the configuration of the club head 10 draws the center of gravity, indicated at 46, of the club head 18 lower than the geometric center of the club head 10, indicated at 48. In a particularly preferred embodiment, the height of the geometric center 48 of the club head 10 from the bottom of the sole plate 18 is approximately 1.11 inches and the height of the center of gravity 46 of club head 10 from the bottom of the sole plate 18 is approximately 0.98 inch. Also, in a particularly preferred embodiment, the depth of the center of gravity is approximately 0.57 inch rearward of the plane 50 thereby positioning the center of gravity of the club head 10 well behind the strike face 12 and well behind the plane 50. The club head's low and deep center of gravity enables the club head 10 to impart less back spin onto a ball at impact and to increase the dynamic loft angle of the club head 10 thereby increasing the carry and roll of the ball. The reduced amount of backspin reduces the ballooning effect. In addition, lower spin reduces the side spin effect, thereby reducing slicing and hooking action of the golf ball. The lower back spin also permits the ball to roll more freely upon landing on the fairway for increased distance. Further, because the center of gravity of the club head 10 tends to align with the hands of the user during a normal golf club swing at impact, a club head having a deep or rearward center of gravity will provide a higher dynamic loft to the ball upon impact than a club head having a forward center of gravity.

The club head 10 achieves the low and deep center of gravity primarily through its geometric configuration and without relying on the use of separate weights or the addition of separate layers of material to the club head 10. The club head's geometric configuration is an efficient, reliable means of primarily achieving a club head with a deep and low center of gravity. The single-walled, unitary configuration of the club head 10 can be more easily and reliably manufactured than other club head configurations having weight ports or compartments for receiving additional weighting or club heads having additional layers or walls of material. Moreover, the geometric configuration of the club head 10 significantly improves the aesthetics of the club head 10.

Figure 6:
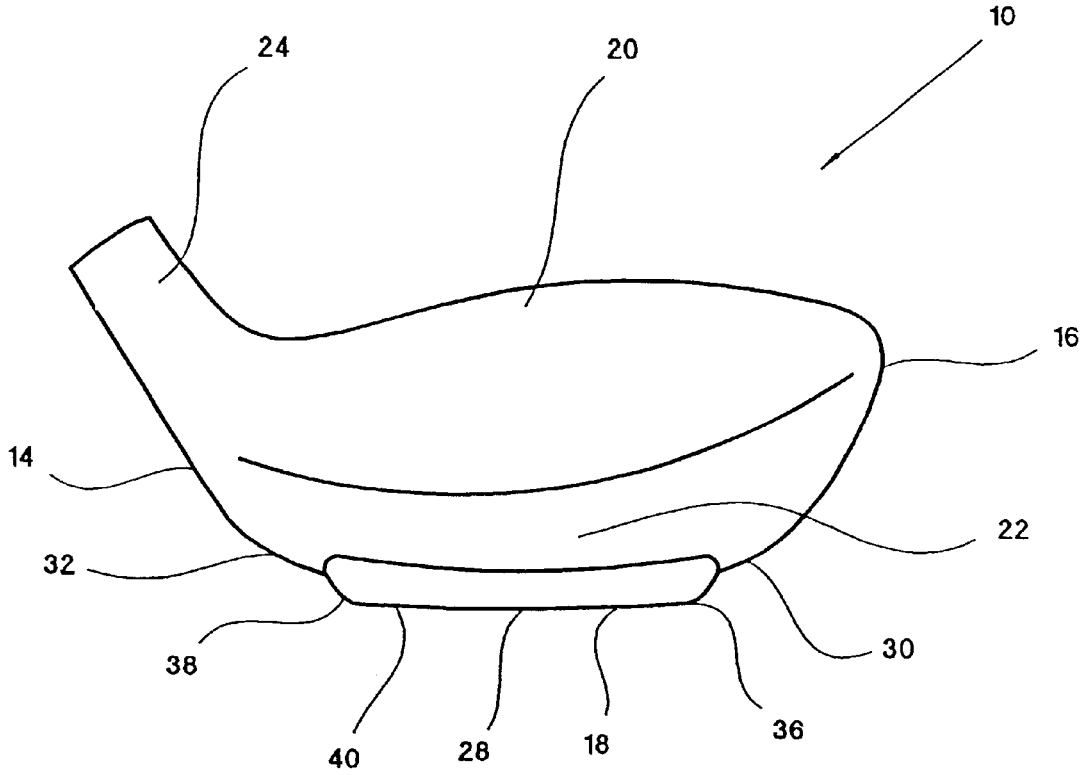
FIG. 6 is a rear view of the golf club head of FIG. 1.

Referring to FIG. 6, the club head 10 is shown in greater detail. The generally planar configuration of the rear central portion 28 of the sole plate 18 and the outward and upward curvature of the first and second side portions 30 and 32 of the sole plate 18 are illustrated. Also, the low, rearward projection of the rear central portion 28 and the low and deep trailing edge 40 of the club head 10 are illustrated. The rearward projection of the rear central portion 28 of the sole plate 18 enables the first and second shoulders 36 and 38 to be seen from the rear view of FIG. 5. The low and deep configuration of the club head 10 draws the center of gravity of the club head 10 lower and deeper.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. An integral, hollow metal golf club head comprising:

a sole plate having a rear sole portion;

a crown having a rear crown portion;

a hosel upwardly extending from the crown, the hosel extending along an axis;

a strike face;

first and second side walls; and a rear wall upwardly and substantially vertically extending from the rear sole portion to the rear crown portion, the rear wall having a lower portion, an upper portion and a rearmost portion, the lower portion of the rear wall at the rearmost portion of the rear wall being substantially parallel with the axis.

2. The golf club head of claim 1, wherein the golf club head is made of a metal selected from the group consisting of a titanium alloy, a stainless steel, and an aluminum alloy.

3. The golf club head of claim 1, wherein the golf club head is one of a wood-type head and a driver head.

4. The golf club head of claim 1, wherein a trailing edge is formed at the connection of the rear sole portion to the rear wall, wherein a leading edge is formed at the connection of the sole plate to the face, and wherein, when the sole plate is positioned on a substantially horizontal surface in a neutral play position, the vertical positions of trailing edge and the leading edge are substantially equal.

5. The golf club head of claim 1, wherein the sole plate has a substantially planar central portion positioned between first and second outwardly and upwardly curved side portions, and wherein the central portion rearwardly extends from the face to the rear wall.

6. The golf club head of claim 1, wherein the sole plate, the rear wall, the first and second side walls and the crown are single walled structures.

7. The golf club head of claim 1, wherein the crown has a first thickness, and wherein the sole plate has a second thickness that is greater than the first thickness.

8. The golf club head of claim 7, wherein the second thickness varies and increases away from the strike face.

9. The golf club head of claim 1 wherein the sole plate, the rear wall, the crown and the first and second side walls are formed as a single piece, and wherein the face is welded to the crown, the first and second side walls and the sole plate.

10. The golf club head of claim 1 wherein the crown, the face, the rear wall and the first and second side walls are formed as a single piece, and wherein the sole plate is welded to the rear wall, the face and the first and second side walls.

11. A single walled, hollow metal golf club head having a geometric center and a center of gravity, the club head comprising:

a crown having a rearwardly extending rear crown portion, the crown having a first thickness;

a sole plate having a rearwardly extending and substantially planar rear sole portion, a substantially planar front central portion, and first and second curved side portions, the sole plate having a second thickness that is greater than the first thickness;

a toe portion;

a heel portion;

a strike face extending between the toe portion and heel portion, the face having an upper edge;

a hosel upwardly extending from the crown and disposed at the heel portion adjacent to the face; and a side wall upwardly extending from the sole plate to the crown, the center of gravity of the club head being lower than the geometric center of the club head, and being rearward of a vertical plane that extends through a centerline of the hosel and is substantially parallel to the upper edge of the face, wherein the width of the rear sole portion increases in a rearward direction adjacent the front central portion of the sole plate to the rearward-most position of the first and second side portions of the sole plate.

12. The golf club head of claim 11, wherein the second thickness varies and increases away from the strike face.

13. The golf club head of claim 11, wherein the golf club head is made of a metal selected from the group consisting of a titanium alloy, a stainless steel, and an aluminum alloy.

14. The golf club head of claim 11, wherein the golf club head is one of a wood-type head and a driver head.

15. The golf club head of claim 11, wherein the side wall includes a rear wall and first and second side walls, and wherein the sole portion is generally planar.

16. The golf club head of claim 15, wherein a trailing edge is formed at the connection of the sole plate to the rear wall, wherein a leading edge is formed at the connection of the sole plate to the face, and wherein, when the sole plate is positioned on a substantially horizontal surface in a neutral play position, the vertical positions of trailing edge and the leading edge are substantially equal.

17. An integral, hollow metal golf club head comprising:

a strike face;

a rear wall; and a sole plate having a substantially planar front and rear central portions positioned between first and second outwardly and upwardly curved side portions, the central portions rearwardly extending from the face to the rear wall, the first and second side portions rearwardly extending to first and second rearmost points on the sole plate, respectively, the sole plate having first and second shoulders formed by the rearward extension of the central portion beyond the first and second rearmost points of the first and second side portions, respectively, the width of the rear central portion of the sole plate varying in a rearward direction and being greatest between the first and second shoulders.

18. The golf club head of claim 15 further comprising a crown, wherein the crown has a first thickness, and wherein the sole plate has a second thickness that is greater than the first thickness.

19. The golf club head of claim 18, wherein the second thickness varies and increases away from the strike face.

20. The golf club head of claim 15, wherein the golf club head is made of a metal selected from the group consisting of a titanium alloy, a stainless steel, and an aluminum alloy.

21. The golf club head of claim 15, wherein the golf club head is one of a wood-type head and a driver head.

22. The golf club head of claim 15, wherein the rear wall substantially vertically and upwardly extends from the sole plate.

* * * * *